US009259043B2

(12) United States Patent
Jones

(10) Patent No.: US 9,259,043 B2
(45) Date of Patent: Feb. 16, 2016

(54) FLEXIBLE FASTENER FOR REMOVABLE ATTACHMENT TO FABRIC

(71) Applicant: Aaron Jones, Rancho Santa Fe, CA (US)

(72) Inventor: Aaron Jones, Rancho Santa Fe, CA (US)

( * ) Notice: Subject to any disclaimer, the term of this patent is extended or adjusted under 35 U.S.C. 154(b) by 0 days.

(21) Appl. No.: 13/849,396

(22) Filed: Mar. 22, 2013

(65) Prior Publication Data

US 2014/0283345 A1 Sep. 25, 2014

(51) Int. Cl.

| | |
|---|---|
| ***A41F 1/00*** | (2006.01) |
| ***A44B 99/00*** | (2010.01) |
| *A44C 3/00* | (2006.01) |
| *A41D 1/00* | (2006.01) |

(52) U.S. Cl.

CPC . *A41F 1/00* (2013.01); *A44B 99/00* (2013.01); *A41D 1/002* (2013.01); *A44C 3/00* (2013.01); *Y10T 24/44863* (2015.01)

(58) Field of Classification Search

CPC ..... B65D 33/1625; A41F 11/02; D06F 55/00; B24F 1/06; Y10T 24/44923; Y10T 24/44769; Y10T 24/44658

USPC ..... 24/532, 545, 535, 543, 563

See application file for complete search history.

(56) References Cited

U.S. PATENT DOCUMENTS

| | | | | | |
|---|---|---|---|---|---|
| 352,325 | A | * | 11/1886 | Jensen et al. | 24/563 |
| 929,380 | A | * | 7/1909 | Blacknall | 24/563 |
| 1,123,231 | A | * | 1/1915 | Bradley | 24/343 |
| 1,330,968 | A | * | 2/1920 | Woods | 24/570 |
| 2,021,619 | A | * | 11/1935 | Waters et al. | 24/532 |
| 2,460,963 | A | * | 2/1949 | Young | 24/30.5 R |
| 3,037,257 | A | * | 6/1962 | Girodet | 24/532 |
| 3,096,553 | A | * | 7/1963 | Gould | 24/487 |
| 4,570,304 | A | * | 2/1986 | Montreuil et al. | 24/30.5 S |
| D332,220 | S | * | 1/1993 | Specht et al. | D9/434 |

* cited by examiner

*Primary Examiner* — Robert J Sandy
*Assistant Examiner* — Matthew Sullivan
(74) *Attorney, Agent, or Firm* — Donn K. Harms

(57) ABSTRACT

A fastening device configured for an easy removable attachment to fabric that is employable with one hand to form a compressive engagement with a mounting point on fabric that is easy to use and non-damaging to fabric. The device can be easily operated by users with limited hand or finger dexterity or only having a single useable hand. The engagement provides a compressive gripping engagement means which is easily positioned to a mounting position on fabric which can be sighted through a gap in a central area of the body of the device. The enhanced gripping means are provided by a toothed gripping means or a friction enhancing means.

11 Claims, 3 Drawing Sheets

FLEXIBLE FASTENER FOR REMOVABLE ATTACHMENT TO FABRIC

BACKGROUND OF THE INVENTION

1. Field of the Invention

The present invention relates generally to clips and fasteners engageable with fabric and textiles. More specifically, the invention relates to a fastening device configured for an easy removable attachment to fabric. The device is formed of a resilient but flexible body having a centrally located aperture and one or more projections extending inwardly toward the aperture center from its edges. Removable engagement is accomplished when the device is flexed, which temporarily exposes projections as they arc away from each other and their respective positions aligned with the plane of the aperture. The body of the device is adapted for a compressive engagement between the thumb and finger(s) of a user. The compression causes arced flexure that deflects the multiple projections to a distanced position. Release of the applied pressure allows the projections to move in an arc back toward a planar position thereby compressing and engaging a section of fabric within the aperture and between the projections.

2. Prior Art

Fasteners for fabrics are widely used throughout the world. Safety pins, clips, buttons, snaps, piercing pins and clasps are a few fabric fasteners that are known in the art. It is additionally known that these and similar devices are employable on many different fabric types and for many reasons.

Garments are a first example wherein conventional textile fabric fasteners are widely used. Most individuals in the modern world have come into contact with a button, snap, or clasp used in garments such as shirts and pants. Other applications of conventional fasteners include jewelry, upholstery, window treatments, and identification tags.

Users will often employ these fasteners without considerable notice since the technology of fabric fasteners has changed little throughout the years and these well known devices are considered the convention for such tasks. However, despite the existence and employment of such devices for many years, there has been little effort to address their inherent disadvantages.

One major problem with many of the fabric fasteners in use, is the high possibility of damaging the fabric and/or the garment during a permanent or temporary engagement of the fastener. Safety pins pose an obvious problem in that they are intended to pierce the fabric they are engaging and may therefore cause permanent damage to tight weave fabrics. Similar problems exist with tie tacks used to secure a necktie to the shirt of the wearer. The continual piercing of the expensive tie fabric will damage the expensive tie. Temporary piercing attachments to fabric, likewise, have the potential to damage the weave or knit of the fabric during use.

Furthermore, with all the piercing style fasteners such as engageable tacks or safety pins, the user risks the pin poking their skin, or the skin of another they are helping, when applying the safety pin to a worn garment or the like. For example, safety pins and tacks and the like are commonly used for engaging name tags or identification tags to a user's shirt, but are communicated in-between the small and generally fragile threads of the weave or knit of the fabric. An accidental tug on the held tag or the fastener causes a stretching of the fabric weave or knit and can easily damage the garment.

Button and snap type fasteners generally require a permanent engagement of the fastener to the fabric, either by sewing in the case of a button, or a riveted or a plied engagement in the case of a snap. As such, the engagement of these fasteners to fabrics is generally done by individuals who are skilled at the technique and have the proper equipment to do so. In the event the fastener is damaged or must be replaced for any reason, it seems that the average person will have great difficulty removing it without also damaging the fabric, and may additionally lack the skill and knowledge necessary to engage the replacement fastener.

There are other inherent disadvantages with conventional fabric fastening devices. Many fastener types, like those described above, require deliberate manipulation of various small parts, by both hands of the user, in order to achieve the desired engagement. Such fasteners are typically sized to be grasped between the user's fingertips on each hand for doing so.

For example, a safety pin requires the user to manipulate the pointed pin in and out of the clasp portion in order to engage or disengage the safety pin as needed. While it can be done with one hand, most people use both hands due to the potential for a stick of the pin, or damage to the fabric. A conventional snap fit fastener generally requires significant compressive force between the thumb and finger of one hand or both, in order to snap the interlocking portions together. Most people employ two hands for such an engagement.

Another example can be seen in a clothing button fastener and button hole engagement. Fastening such a fastener requires the user to maneuver the body of the button through the buttonhole and most people again must use two hands to accomplish the task without great difficulty.

Because of the complicated nature of such fasteners, engagement and disengagement thereof, requires the application of a great deal of finger dexterity and strength to the fastener components for use. Without the ability to provide such with both hands, most such fasteners are rendered useless. Therefore, users with limited dexterity, or limited hand use, due to health or other reasons, are extremely limited in use of these conventional devices.

As a result, prior art has attempted to provide widely varying improvements in the art of fasteners and the like, many of which attempt to provide fastening means that are non-damaging and easy to use.

U.S. Pat. No. 3,962,757 to Gedney which teaches a fastener having a resilient body that is formed with a plurality of passages, each of which includes a plurality of passages having undulating edges for holding webs of a fabric-like material captive when communicated through the passages. Each grip constitutes a corrugated slit that is formed with an opening at each of its ends. However, Gedney requires the fabric being connected to be engaged through the slit to function.

U.S. Pat. No. 5,987,708 to Newton teaches a restraint device, having a rigid edge and flexible center. In the flexible center is a flexible gripping strip opening where gathered material is inserted through, after communication, through an adjacent aperture to keep the fabric in the aperture held in place.

U.S. Pat. No. 1,389,304 to Holmes teaches a garment supporter comprising a thin body having a pair of tongue portions extending away from each other at a common engagement to the center. Two openings through which fabric is communicated are formed by bending the body of the clip, adjacent the distal ends of the two opposing tongue portions. In addition to forming two different openings by bending the body of the fastener, the Holmes fastener requires a second hand to feed the fabric through the opening held open by one hand.

Although these widely varying attempts of prior art fasteners provide fastening means are trying to solve the problem of engaging two pieces of fabric, all appear from their illustrations and teach to require one hand to flex the fastener and a second hand to feed fabric thorough one of multiple apertures in the fastener body. As such, there is a continuing unmet need for an improved fabric fastening device that employs easy-to-use and non-damaging engagement, and that is configured for employment using one hand, to provide a fabric fastener engagement for securing garment portions to each other, or for engagement of decorative attachments or name tags and badges, to a fabric garment using one hand and without damage.

Such a device should be relatively simple to use and be easily manipulated and fastened, using one hand, and require minimal manipulation of the fabric providing the mount by the user to secure the device to the intended position on the fabric. Such a device should not require the communication of fabric portions completely through one or multiple apertures in order to operate, so that users with limited dexterity, and just one hand, can easily target the attachment point for the fastener and configure and attach it thereto with that single hand. In addition, such a device should be advantageously cost effective to manufacture.

The forgoing examples of related art and limitations therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings of the widely divergent prior art and cures the shortcomings of the prior art. It provides a novel fabric fastening device using a single aperture or gap through which a target fastening position can be viewed, and providing a one hand activated means for compressive engagement of the fastener, to the desired mounting position on a piece of fabric, which is easy to use and non-damaging.

In accordance with at least one preferred mode, the device is formed of a resilient, flexible, elongated planar body. The body portion has a centrally located aperture and at least one projection extending toward one edge of the formed aperture from an engagement point to a distal edge of the aperture. In a particularly preferred mode of the device, providing excellent engagement to fabric, the number of projections extending in the aperture is two and each extends inwardly toward the other to a gap therebetween, from opposing distal edges engaged with the formed aperture.

The proximal ends of the projections are preferably spaced a distance apart defining a gap therebetween which is situated in a central portion of the aperture. Further, the proximal ends of each of the projections preferably have one or a plurality of undulating surfaces or gripping teeth which when compressing fabric therebetween, provide an enhanced engagement therewith as will become apparent shortly.

The fastener device, when flexed, causes an arced translation of the ends of the projections, to opposing positions in a second plane separate from that of the body of the fastener. This provides a temporary exposure of the opposing projections, and the gap therebetween, in the second plane.

In use, the edges of the body of the device are adapted for a compression engagement between the thumb and finger(s) of a single hand of the user. By compressing the body edges, the user with one hand causes the arced flexure which deflects the two projections from the plane of the aperture in the plane of the fastener, to a position in a second plane, with the gap between the proximal ends of the projections also therebetween, and larger. The bias of the flexed material forming the fastener, during a release of compressive pressure on the ends of the fastener body, causes the ends of the two projections, and gap therebetween, to move in an arc to a position within the plane of the body of the fastener or immediately adjacent thereto. During this return, fabric positioned in the wider gap of the deflected opposing projections is drawn into a compressive engagement between the two projections within the smaller gap therebetween which returns when the compression of the body ceases. The compressive engagement is enhanced by the undulating or toothed proximal edges at the projection ends when the gap reduces in size due to cessation of compression. Thus, the compressive engagement between the terminating edges of the two projections, maintained by the inward bias of the projections to form the narrower gap therebetween, provides a non-damaging yet very secure engagement of the device, to the targeted point of the fabric, using a single hand.

The provision of the gripping teeth at the edges of both projection adjacent to the gap, further acts as a means for enhancing the compressive engagement to prevent a sliding of the fastener while fastened to the fabric, as the fabric captured and compressed in the smaller gap, is compressed in small opposing sections. Furthermore, in other modes, the toothed ends can be replaced by friction enhancing material, such as a soft compressing rubber or the like, to reduce the chance of the projections tearing into the fabric if pulled very hard or in modes of the device where the narrow mode of the gap is very narrow and provides extra compression. Removal of the device, using a single hand, generally involves a reversal of the engagement steps described above.

In a preferred as used mode, the device is configured for an easy engagement to a planar member, such as a badge, identification tag, name tag, or the back side of a piece of jewelry, or the like, such that the one handed secure functional benefits of the fastening device can be employed in such a manner to attach badges, tags, jewelry and the like to garment fabrics. Additionally, the fastener device can be formed as part of the planar badge, identification tag, name tag, or the like and either glued or fastened thereto, or manufactured as unitary structure with a single resilient, flexible body of a size that can be easily compressed using the thumb and finger(s).

In another preferred as used mode, the device is configured for removable coupling with a wire, cable, electrical cord, or the like thereby allowing attachment and strain relief of the electrical conduit to fabric. For example, the resilient, flexible, and elongated planar device described above may include attachment points distal to the central aperture that can be used for coupling with stereo headphone cables in a way that allows the device body to be manipulated as previously described to engage to a music listener's shirt.

Furthermore, it is noted that upon reading the detailed descriptions of the preferred modes of the device, those skilled in the art will recognize various other ways the device can be applied, and without departing from the overall scope and intent of the invention, are considered part of this disclosure. For example, in yet additional modes, the device may be adapted to engage a necktie to a garment collar, to fasten a diaper, or to attach a sporting event number to an athlete's clothing. It is additionally noted that upon a reading this disclosure, those skilled in the art will recognize various means for carrying out these intended features of the invention. As such it is to be understood that other devices configured to carry out these features are considered to be within the scope and intent of the present invention, and are anticipated.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways that will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the invention to provide a fabric fastening device employable with one hand to form a compressive engagement with a mounting point on fabric that is easy to use and non-damaging to fabric.

It is an object of the invention to provide a fastening device that can be easily operated by users with limited hand or finger dexterity or only having a single useable hand.

It is another object of the invention to provide a compressive gripping engagement means which is easily positioned to a mounting position on fabric which can be sighted through a gap in a central area of the body of the device.

It is another object of the invention to provide an enhancing gripping means provided by a toothed gripping means or a friction enhancing means.

It is yet another object of the invention to provide a fabric fastener configured for easy and secure compression between the thumb and finger(s) of a user in the as used mode.

These and other object features and advantages of the present invention, as well as the advantages thereof over existing prior art, which will become apparent from the description to follow, are accomplished by the improvements described in this specification and hereinafter described in the following detailed description that fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

Figure 1:
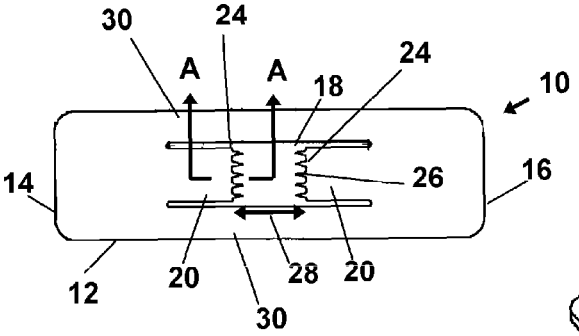
FIG. 1 shows a top view of a first particularly preferred mode of the device comprising a resilient and flexible elongated planar body having a centrally located aperture and two projections extending inwardly from opposing distal edges of the aperture.
Figure 4A:
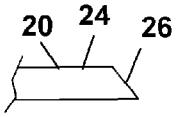

FIG. 4*a* shows a cross section view of a particularly preferred pointed gripping tooth disposed at the proximal end of the projections as seen from line AA of FIG. 1.

Figure 4B:
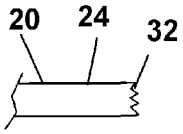

FIG. 4*b* shows another preferred mode of the proximal ends of the projections providing rows of vertically disposed pointed teeth.

Figure 4C:
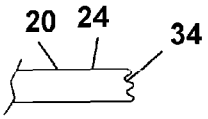

FIG. 4*c* shows yet another preferred mode of the proximal ends of the projections providing rows of vertically disposed rounded teeth.

Figure 4D:
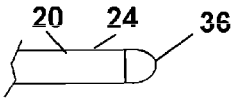

FIG. 4*d* shows still yet another preferred mode of the proximal ends of the projections providing friction enhancing material engaged to the proximal ends.

Figure 5:
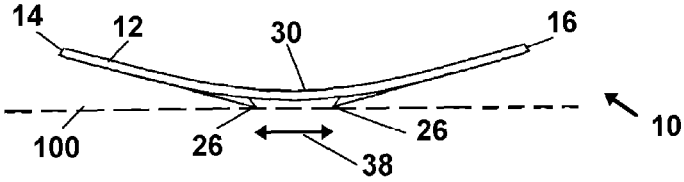

FIG. 5 shows an as used position of the device in the flexed mode as needed for gripping a portion of fabric for an engagement between the proximal ends of the projections.

Figure 6:
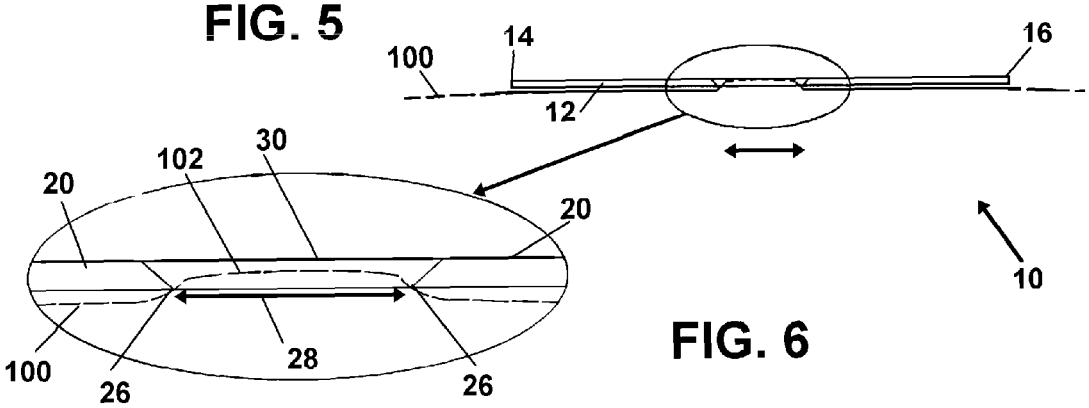

FIG. 6 shows another as used gripping position of the device in the relaxed mode having a portion of the fabric material compressed within an engagement between the proximal ends of the projections.

Figure 7:
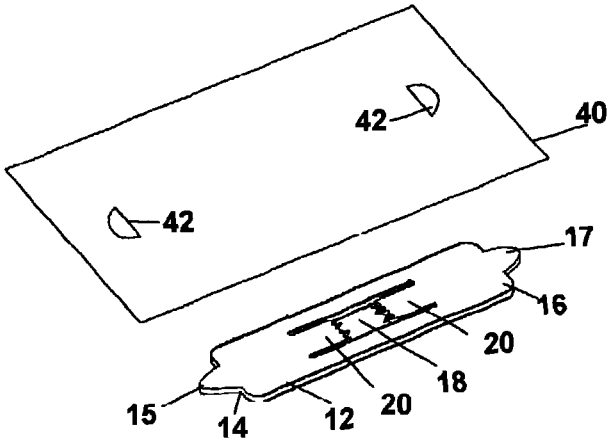

FIG. 7 shows another preferred mode of the device employing opposing engagement tabs configured for an engagement with a planar member, wherein the planar member comprises a badge, identification tag, or the like.

Figure 8:
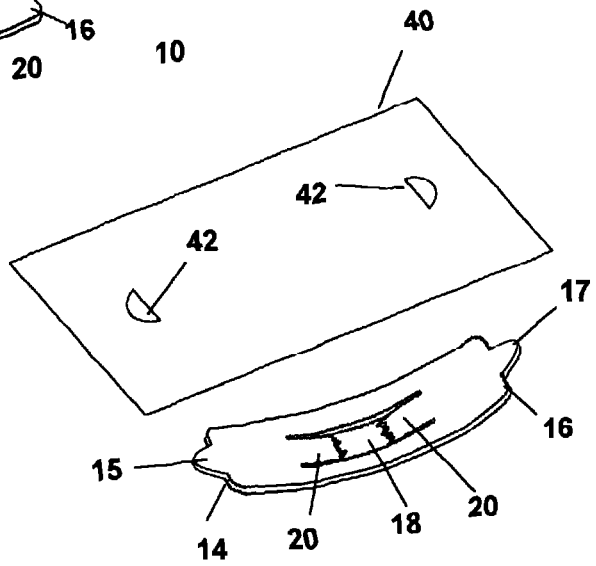

FIG. 8 shows the fastening device being flexed prior to an engagement with the planar member having receiving apertures for engaging the opposing tabs on the fastening device.

Figure 9:
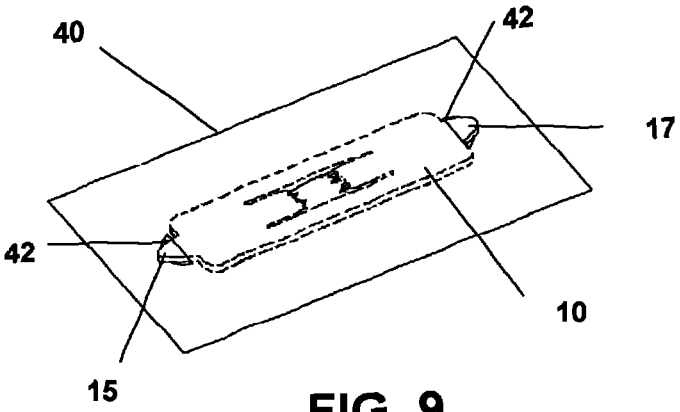

FIG. 9 shows the final as used position of the device of the current mode showing the fastening device and planar member cooperatively engaged.

Figure 10:
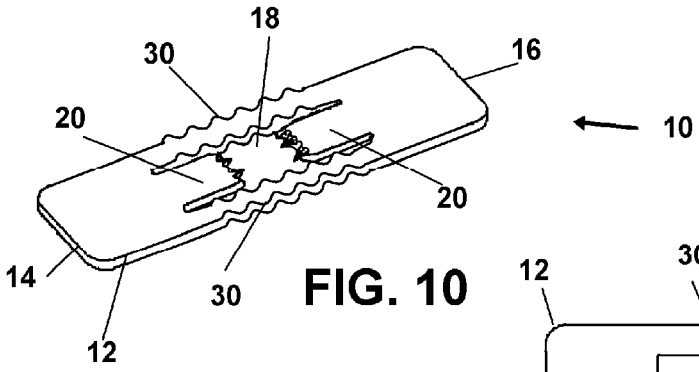

FIG. 10 shows a view of another particularly preferred mode of the invention wherein the body of the device is especially well adapted for flexure.

Figure 11:
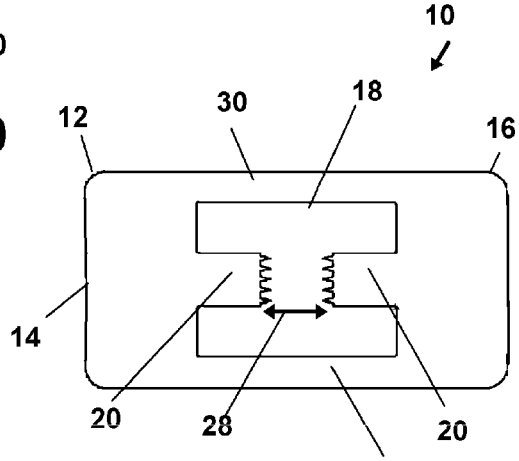

FIG. 11 show a view of an additional preferred mode of the device formed of varying geometries and configurations.

Figure 12:
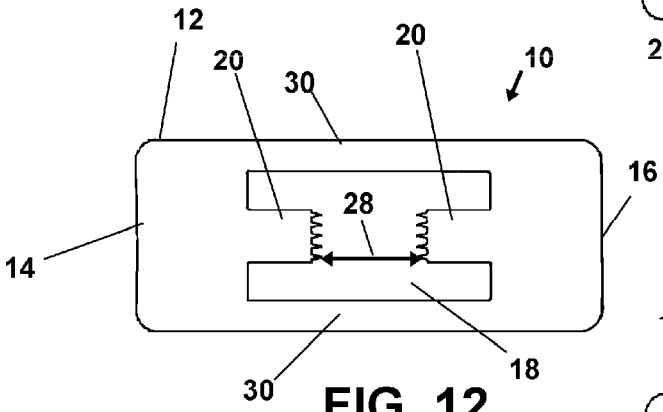

FIG. 12 show a view of still additional preferred mode of the device formed of varying geometries and configurations.

Figure 13:
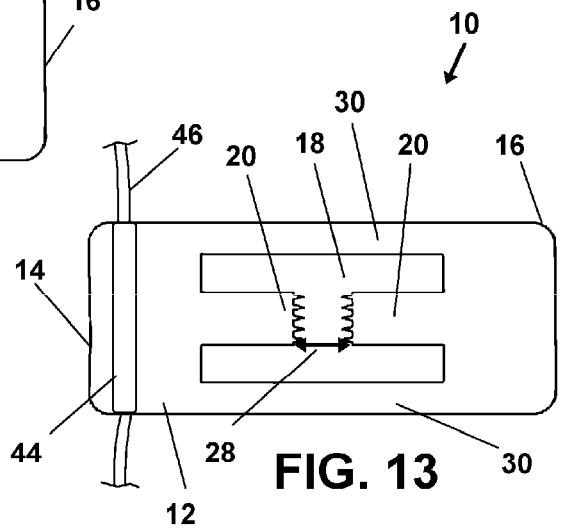

FIG. 13 depicts another preferred mode of the device configured with mean for removable engagement with a cable, wire, electrical cord, or the like.

Figure 14:
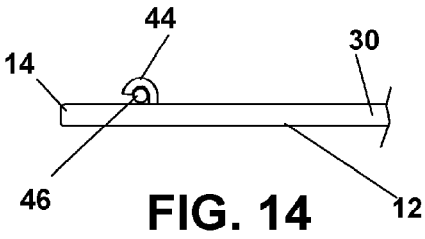

FIG. 14 shows a partial side view of the mode of the device of FIG. 13.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 2:
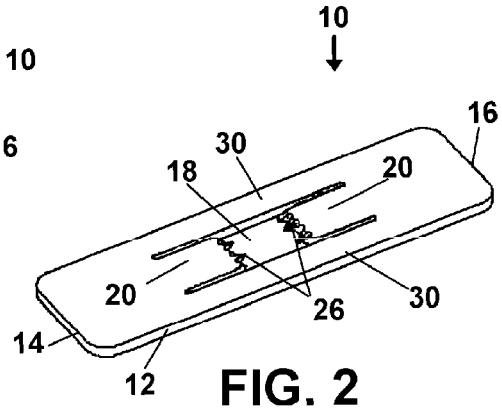
FIG. 2 shows a perspective view of the device of FIG. 1 in a relaxed mode.
Figure 3:
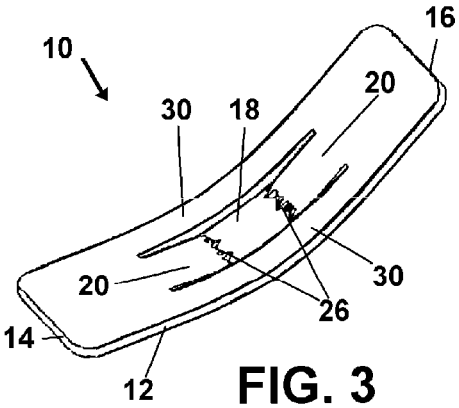
FIG. 3 shows the device of FIG. 1 in a flexed mode that exposes the proximal ends of the projections from the plane of the aperture.

Now referring to drawings in FIGS. 1-14, wherein similar components are identified by like reference numerals, there is seen in FIG. 1, FIG. 2, and FIG. 3 views of a first particularly preferred mode of the fabric fastening device 10 providing a means for a compressive removable engagement to fabric 100 that is easy to use with only one hand, and non-damaging to the fabric 100. In accordance with at least one preferred mode, the device 10 is formed of a resilient flexible and elongated planar body 12 comprising a first end 14 and a second end 16. The body 12 includes a substantially centrally located aperture 18 formed in between the two ends, and two shoulder portions 30 disposed at or near the longitudinal side edges of the body 12 of the device 10, and adjacent to the aperture 18.

Additionally included is at least one projection 20, extending inwardly in a direction parallel with the shoulder portions 30, from at least one edge of the aperture 18, toward the other edge or towards an imaginary centerline. This positions a gap between the end of the single projection 20 and the opposing edge of the aperture 18.

However, preferably, the device 10 features an aperture 18 having two projections 20 as shown in the figures. Each such projection 20 extends from an opposite side of the aperture 18 toward the other of the projections 20, and terminate at opposing proximal ends a distance from each other forming a gap 28 therebetween with the device 10 is in a relaxed mode, such as in FIG. 2, where that is the body 12 is substantially flat or planar.

Further preferred, the proximal ends 24 of each of the projections 20 preferably are configured in an undulating fashion so as to form one or a plurality of gripping teeth 26. The gripping teeth 26 as noted below, provide an enhanced means for a compressive engagement with the fabric 100 in the as used-mode shown of the device 10 where it has been flexed and returned to a planar state after positioning the fabric 100 within the gap. This undulating or uneven edge forming the teeth 16, provide for a varying engagement of the fabric 100 which provides a means for preventing translation of the fabric 100 when in compressive engagement within the gap 28.

The various components of the device disclosed herein can be formed of rigid yet pliable materials which flex but return to an original state, such as plastic, resin, or metal. However, the components can be formed of any material which is rigid yet will deflect when compressed from opposing ends, which is suitable for the purposes set forth in this disclosure.

The device 10 can be manufactured using known techniques such as manual cutting, conventional machining, water jet cutting, laser cutting, die cutting, stamping, or injection molding. Further, those skilled in the art will recognize that the device 10 is shown constructed as unitary piece of material which works well and simplifies manufacture, however other modes may be formed using a plurality of components that are operatively engaged to form the device. Therefore it is noted that the various means for construction of the device that accomplishes the intended features set forth in this disclosure, are anticipated.

The device 10 when flexed as shown in the flexed modes of FIG. 3 and FIG. 5, cause an arced translation and temporarily exposes the edges of the opposing projections 20 and/or toothed ends 26, and the gap therebetween in a larger state, when they arc away from their first position, within are immediately adjacent to the plane of the aperture 18 formed in the planar body 12.

In use, the body 12 of the device 10 is configured in size to place the first and second ends in position for a compression between the thumb and finger(s) of one hand of a user by a contact with the ends 14 and 16. The force of this finger and thumb generated compression, causes the arced flexure that deflects the two projections 20 from their closest positioning point defining the gap 28, to a distanced position 38. This distance position 38 increases the size of the gap 28 to a larger distance 38 between the proximal ends 24, thereby rendering the gap 28 to a position out of the plane of the body 12 and the aperture 18, and is enlarged. This gap 28 having the larger distance 38, is maintained in the enlarged position, distanced from the body 12 and aperture 18, as long as the user maintains the compressive force with their finger and thumb or two fingers.

This arc and deflected position of the gap 28, distanced away from the body 12 and enlarged, is shown in FIG. 5. As depicted, the projections 20 are deflected to position with their proximal ends having toothed ends 26, spaced away from the plane of both the body 12 and the aperture 18, and, with a gap 28 having an increased distance 38, of the gap 28 in the relaxed state of FIG. 1 or 2 or 10, for instance.

In this deflected position, the device 10 positions the deflected gap 28, in the enlarged distance 38, in the spaced position allowing the user to easily see the intended mounting position for the fabric 100, through the gap 28, either from the side view as in FIG. 5, or through the aperture 18, as in FIG. 3. This makes it easy to move the gap 28 to the desired engagement point on the fabric 100 while watching it being moved. As such, once a targeted mounting position on the fabric 100 is viewed through the gap 28 or aperture 18, the user moves the device 10 to position the two proximal ends, such as the toothed ends 26, in an abutted and slightly pressured contact with the targeted mounting position with a portion of fabric 100.

With the enlarged gap 28, and proximal edges defining it pushed against the determined target or mounting position on the fabric 100, which is easily seen through the aperture 18, or from a side view since the proximal edges of the two projections 20 are deflected away from the aperture 18 and body 12, a release of the compression on both the ends 14 and 16 by the user, starts the return of the device 10 to the relaxed mode of FIG. 1 or 2. With the proximal edges or toothed ends 26 of the two projections 20 pressed against the fabric 100, as the device 10 returns to the relaxed mode, the gap 28 and the two projections 20 on each side of it, move in an arced translation, back to a position substantially inline with and parallel with the formed aperture 18 and body 12. This causes an arcing movement and scooping by the toothed ends 26 as a compressive engagement with a portion of the fabric 100 such as in FIG. 6. This scooping engagement helps to pull and thereby maintain the portion of fabric 100 into and within the aperture 18.

As noted, in the relaxed mode, with the gap 28 returned to a position within, or immediately adjacent to the aperture 18 and planar body 12, the gap 28 is returned to the smaller size from the enlarged distance 38 wherein the fabric 100 was placed therebetween. This reduction of the gap 28 from the enlarged distance 38 to the smaller distance, causes the compression of the proximal edges or toothed ends 26 of the projections 20, on both sides of the gap 28, to compress the fabric 100 portion which has been scooped and positioned therebetween, when the gap 28 was in the enlarged distance 38, into a compressed engagement therewith.

Thus, the combination of the flexure of the body 12 of the device 10, and the deflection of the gap 28 and opposing ends of the projections 20, in and out of the plane of the aperture 18 and body 12, provide both a means to position the device 10 in the correct viewed position on the fabric 100, and a means for compressive engagement of the fabric 100 which has been abutted and scooped in-between the toothed ends 26. This yields a non-damaging, accurately positioned engagement of the device 10 that is very secure to the fabric 100.

As noted, in the preferred mode, the proximal ends of the projections 20 have gripping teeth 26 which further act as a means for enhancing the compressive engagement. This is due to the substantially pointed ends of the teeth 26, as shown in FIG. 4*a*, which grip the individual fibers of the fabric 100 along both edges in an uneven fashion which helps prevent slippage and enhances the ability to hold the fabric 100 in place.

In addition, it is preferred that the teeth 26 are of a size that do not pierce through the fabric 100, but merely provide an undulating grip on the surface fibers of the fabric 100 scooped into and positioned within the aperture 18. However, in other modes wherein extreme secured engagement are desired, the teeth 26 may be configured to communicate through the threads or fibers woven or knitted to form the fabric 100 when acted upon by the compressive force between the projections 20 in the as-used mode. Removal of the device 10 from the fabric 100 generally involves a reversal of the engagement steps described above.

FIG. 4*b*, FIG. 4*c*, and FIG. 4*d* show additional modes of the proximal ends 24 of the projections 20 of the device 10 providing alternative means for enhanced compressive engagement therebetween. In FIG. 4*b*, the proximal end 24 includes vertically opposed gripping teeth 32 that extend the lateral width of the proximal end 24. This mode may be preferred since the pointed ends can be formed substantially shorter and may resist piercing into the fabric 100. FIG. 4*c* shows yet another mode, similar to FIG. 4*b*, however having curved ends that will not pierce into the fabric 100, but may be sized to grip individual surface fibers of the fabric.

FIG. 4*d* shows a particularly preferred mode, wherein the proximal ends 24 include friction enhancing material 36, such as a soft rubber or the like. This can be formed in a two-shot injection molding process, or other suitable forming means. It is noted and anticipated that those skilled in the art, upon being educated by this specification, will recognize various other means for enhancing the compressive engagement of the device 10 to a portion of fabric 100, and any such enhancement as would occur to those skilled in the art are considered part of this disclosure and included in the claims herein.

In yet another preferred mode of the invention shown in FIG. 7, FIG. 8, and FIG. 9, the device 10 is configured for a removable engagement to a planar member 40, wherein the planar member 40 comprises any one of a group of planar members including a badge, an identification tag, a name tag, the rear of a piece of jewelry or a jewelry mount, or the like. In such fashion the functional benefits of the fastening device 10, can be easily employed to attach badges, tags, and the like to garment fabrics 100.

As currently depicted, the device 10 includes engagement tabs 15 and 17 extending from the distal ends 14 and 16 of the body 12 of the device 10, respectively. The tabs 15 and 17 are configured to engage within receiving apertures 42 disposed on the planar member 40. After a release of pressure causing flexure of the device 10 as in FIG. 8, wherein the device 10 is biased back into the relaxed mode, the tabs 15 and 17 can be communicated into the receiving apertures 42 for securely engaging the device 10 to the planar member 40 as in FIG. 9.

However, other means for engagement may be employed and are anticipated. For example, device 10 can be made to engage fabric 100 by way of a clearance aperture in the planar member 40 in a way that avoids direct attachment of device 10 to the planar member 40 but holds the planar member 40 securely to fabric 100 nonetheless. In this mode the planar member 40 is sandwiched between device 10 and fabric 100 as projections 20 engage fabric 100 through a clearance aperture in the planar member 40.

Also for example, should the planar member 40 also be substantially flexible, portions of the body 12 of the device 10 not including the projections 20, can be permanently mated to the planar member 40 by adhesives or the like. Thus, the user will flex the combination of the device 10 and planar member 40 for engaging to fabrics 100, in the steps described previously. Also for example, should the planar member 40 also be substantially flexible, features from device 10 can be formed directly in the planar member 40 material thereby eliminating the need for a body 12.

Furthermore, it is noted that in yet additional modes not explicitly shown, the device 10 may be engaged to non-planar items. Of course any non-planar item will preferably employ suitable engagement means, such as receiving cavities 42, or if the non-planar item is substantially flexible, the device 10 can be permanently engaged thereon. Those skilled in the art will recognize any slight or moderate modifications to the device 10 and/or the item to be engaged, as needed to achieve such an engagement, and are anticipated.

Although the device 10 is most preferably suited for construction out of flexible plastics and the like, it is noted that the device 10 can additionally be formed from more durable and rigid materials in order to provide a fastening device 10 which itself is substantially durable and capable of higher degrees of secured engagement to fabrics.

FIG. 10 shows a mode of the device 10 that may be suitable for construction from metal, such as spring steel, stainless steel, or other suitable material. In this mode the flexible shoulders 30 are formed to allow the generally more rigid metal to flex and bend upon an engagement of the distal ends 14 and 16 between the thumb and finger of the hand of a user. Currently, the shoulders 30 are shown having substantially curvilinear cross sections, which more suitably allow for flexure of the generally rigid metal.

FIG. 11, and FIG. 12 show yet additional preferred modes of the device 10 formed of various other configurations. As shown, and especially noted herein, the device 10 is capable of various modifications, namely, in the size and shape of the aperture 28, the length and width of the shoulders 30, the length and width of the projections 20, the distance of the gap 28, and the overall length and width of the body 12 of the device 10. The construction of these features of the device 10 may be formed as deemed satiable by the designer while still providing the intended features and advantages described herein, are considered part of this disclosure, and are anticipated.

In addition, FIG. 13 and FIG. 14 show another preferred mode of the device 10 configured with a means for removable engagement with a cable 46, wire, electrical cord, or the like thereby allowing attachment and strain relief of the electrical cable 46 to fabric 100. For example, the resilient, flexible, and elongated planar device 10 described above may include an attachment member 44 on the body 12 that can be used for coupling with stereo headphone cable 46 such that the as used mode of the device 10 provides a means for securing the cable 46 to a music listener's shirt. Those skilled in the art may recognize other means for removable engagement with a cable, wire, or the like that are slightly or moderately different than the depiction of the attachment member 44 in the figure, they are still considered within the scope and intent of the invention, and are therefor anticipated in this disclosure.

This invention has other applications, potentially, and one skilled in the art could discover these. The explication of the features of this invention does not limit the claims of this application; other applications developed by those skilled in the art will be included in this invention.

Thus, upon reading this disclosure, those skilled in the art may recognize various other means for compressive engagement to fabrics that are non-damaging and easy to use, which are considerably or slightly different those disclosed, are considered within the scope and intent of the invention herein, and are anticipated within the scope of this patent.

It is additionally noted and anticipated that although the device is shown in its simplest form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention.

Consequently, all such modifications and variations and substitutions are included within the scope of the invention as defined by the following claims.

What is claimed:

1. A fabric fastening device comprising:

a substantially planar body extending a distance from a first end, to a second end opposite the first end;

an aperture located in a central portion of said body, said aperture having an area within a plane extending surrounded by a circumferential edge;

a pair of identically shaped projections extending within said plane from said opposing sides of said circumferential edge of said aperture to respective proximal ends;

a gap having a first distance when positioned centrally between said proximal ends substantially within said plane in a first position of said proximal ends;

said planar body having a flexed position curving between said first end and second end;

said proximal ends of said projections located to a second position, a distance outside said plane, and defining said gap in a second distance with said planar body in said flexed position;

said second distance of said gap being larger than said first distance;

said fabric slidably positionable between said gap at said second distance; and said gap at said first distance, forming a non-damaging compressive engagement of any said fabric therebetween.

2. The fabric fastening device of claim 1, additionally comprising:

an arced path followed by said pair of projections from said circumferential edge to said proximal ends during a return from said second position to said first position; and said pair of projections in said arced path defining a scoop, said scoop imparting a non-damaging scooping to any said fabric positioned within said gap at said second distance during said return of said proximal ends from said second position to said first position, and said scooping pulling a portion of said fabric into said compressive engagement within said gap at said first distance.

3. The fabric fastening device of claim 1, additionally comprising:

teeth formed upon said proximal ends; and said teeth engageable between threads of said fabric and in combination with said compressive engagement providing a means to prevent a sliding of said fabric from said gap.

4. The fabric fastening device of claim 2, additionally comprising:

teeth formed upon said proximal ends; and said teeth engageable between threads of said fabric and in combination with said compressive engagement providing a means to prevent a sliding of said fabric from said gap.

5. The fabric fastening device of claim 1, additionally comprising:

opposing shoulder portions of said body formed between opposing longitudinal side edges of said body, and said aperture; and said shoulders providing for said curving of said body primarily within said central portion with said body in said flexed position.

6. The fabric fastening device of claim 2, additionally comprising:

opposing shoulder portions of said body formed between opposing longitudinal side edges of said body, and said aperture; and said shoulders providing for said curving of said body primarily within said central portion with said body in said flexed position.

7. The fabric fastening device of claim 3, additionally comprising:

opposing shoulder portions of said body formed between opposing longitudinal side edges of said body, and said aperture; and said shoulders providing for said curing of said body primarily within said central portion with said body in said flexed position.

8. The fabric fastening device of claim 4, additionally comprising:

opposing shoulder portions of said body formed between opposing longitudinal side edges of said body, and said aperture; and said shoulders providing for said curving of said body primarily within said central portion with said body in said flexed position.

9. The fabric fastening device of claim 1, additionally comprising:

said distance from said first end to said second end being of a length for a positioning between a thumb and finger of one hand of a user.

10. The fabric fastening device of claim 2, additionally comprising:

said distance from said first end to said second end being of a length for a positioning between a thumb and finger of one hand of a user.

11. The fabric fastening device of claim 4, additionally comprising:

said distance from said first end to said second end being of a length for a positioning between a thumb and finger of one hand of a user.

* * * * *